US008905531B2

(12) United States Patent
Qian et al.

(10) Patent No.: US 8,905,531 B2
(45) Date of Patent: Dec. 9, 2014

(54) INK TANK AND PRINTER THEREWITH

(71) Applicant: Qisda Optronics (Suzhou) Co., Ltd., Suzhou, Jiangsu Province (CN)

(72) Inventors: Ming-Kuan Qian, Suzhou (CN); Zhenglong Hu, Suzhou (CN)

(73) Assignee: Qisda Optronics (Suzhou) Co., Ltd., New District, Suzhou, Jiangsu Province (CN)

( * ) Notice: Subject to any disclaimer, the term of this patent is extended or adjusted under 35 U.S.C. 154(b) by 0 days.

(21) Appl. No.: 14/073,883

(22) Filed: Nov. 7, 2013

(65) Prior Publication Data

US 2014/0184709 A1 Jul. 3, 2014

(30) Foreign Application Priority Data

Dec. 27, 2012 (CN) ..... 2012 1 0579039

(51) Int. Cl.
*B41J 2/175* (2006.01)

(52) U.S. Cl.
CPC ..... *B41J 2/17513* (2013.01)
USPC ..... 347/86; 347/87

(58) Field of Classification Search
CPC ..... B41J 2/17513; B41J 2/17523; B41J 2/17553; B41J 2/17555
USPC ..... 347/86, 87
See application file for complete search history.

(56) References Cited

U.S. PATENT DOCUMENTS

| | | | | |
|---|---|---|---|---|
| 6,132,036 | A * | 10/2000 | Abe et al. | 347/86 |
| 6,776,478 | B1 * | 8/2004 | Anderson et al. | 347/85 |
| 6,880,925 | B2 * | 4/2005 | Yamaguchi et al. | 347/87 |

FOREIGN PATENT DOCUMENTS

| | | |
|---|---|---|
| CN | 2837080 | 11/2006 |
| CN | 201176026 Y | 1/2009 |
| JP | 2009125945 | 6/2009 |

* cited by examiner

*Primary Examiner* — Anh T. N. Vo
(74) *Attorney, Agent, or Firm* — Winston Hsu; Scott Margo

(57) ABSTRACT

The present invention is to provide a printer and an ink tank therein. The ink tank includes a tank body, a first pillar, a resilient component, a lid, a second pillar and a waterproof moisture-permeable assembly. An ink filling port and a first opening are formed on an upper side of the tank body. The first pillar and the resilient component are disposed in the first opening and forming an openable intake passage cooperatively. The lid covers on the upper side of the tank body, a second opening and a second pillar are formed on the lid. The second pillar includes a communicating portion, and a waterproof moisture-permeable assembly is disposed on the lid and communicating with the communicating portion through the second opening. The present invention is to prevent the waterproof moisture-permeable assembly from being stuck by ink when the printer is not in printing operation.

18 Claims, 5 Drawing Sheets

INK TANK AND PRINTER THEREWITH

BACKGROUND OF THE INVENTION

1. Field of the Invention

The present invention relates to an ink tank and a printer therewith, especially to an ink tank and a printer therewith capable of preventing ink inside the ink tank from splashing to a waterproof moisture-permeable assembly when the printer is not in printing operation or the ink tank is not installed in the printer.

2. Description of the Prior Art

Please refer to FIG. 1. FIG. 1 is a partial structural diagram of a conventional ink tank in the prior art. The conventional ink tank of a printer includes an ink tank body 1, and the ink tank body 1 includes an upper housing 2 and a lower housing 3. Ink 4 is contained in a chamber enclosed by the upper housing 2 and the lower housing 3 cooperatively, and an ink filling port 6 and a breath port 7 are disposed on a top side 5 of the upper housing 2 . As the ink 4 is reducing, outside air passes through the breath port 7 and flows into the chamber so as to keep the ink tank body barometric equilibrium for normal ink supply. The position of the breath port 7 has to be decided for preventing the ink 4 from flowing out through the breath port 7 as the ink tank is installed in the printer in a normal operation. However, the printer or the ink tank may tilt during transportation or storage so that the ink 4 flows out through the breath port 7. It results in the waste of the ink, and the ink may smudge everywhere. In addition, a waterproof moisture-permeable assembly 8 is installed on the breath port 7 of the upper housing 2 for waterproofing and exchanging the air. When the ink tank is crashed, the ink 4 may flow out through the breath port 7 and splash the waterproof moisture-permeable assembly 8, resulting in apart of the waterproof moisture-permeable assembly 8 or the whole waterproof moisture-permeable assembly 8 being stuck so that the permeability of the ink tank decreases and the flowing velocity of the ink slows down. Therefore, the printer may not print normally, and a package for preventing the ink tank from being crashed is utilized with higher cost.

SUMMARY OF THE INVENTION

A purpose of the present invention is to provide an ink tank and a printer therewith capable of preventing ink inside the ink tank from splashing to a waterproof moisture-permeable assembly when the printer is not in printing operation or the ink tank is not installed in the printer, so as to solve the problem that the waterproof moisture-permeable assembly may easily be stuck.

For achieving the above purpose, the present invention is to provide an ink tank. The ink tank includes a tank body, a first pillar, a resilient component, a lid, a second pillar and a waterproof moisture-permeable assembly. A chamber is formed inside the tank body for containing ink, an ink filling port and a first opening is formed on an upper side of the tank body. The first pillar is disposed in the first opening. The resilient component is engaged with the first pillar and is disposed in the first opening, the first pillar and the resilient component is engaged with the first opening to form an openable intake passage communicating with the chamber. The lid covers on the upper side of the tank body, and a second opening is formed on the lid. A second pillar is disposed on a first surface of the lid facing to the upper side of the tank body. The second pillar includes a communicating portion communicating with the second opening and the intake passage. A waterproof moisture-permeable assembly is disposed on the lid and communicating with the communicating portion through the second opening. The resilient component is compressed to drive the first pillar to contact against a first inner wall of the tank body so as to close the intake passage as the tank body is uncovered by the lid. The second pillar is inserted into the first opening to press the first pillar so as to form a first gap between the first pillar and the first inner wall, for opening the intake passage so as to communicate the chamber and outside atmosphere as the tank body is covered by the lid.

Optionally, the first opening includes a first part and a second part, the second part is larger than the first part, the first part is disposed adjacent to the lid, the first pillar and the resilient component are disposed in the second part, an end of the resilient component contacts against the first pillar, and the other end of the resilient component contacts against a second inner wall near the second part.

Optionally, the first opening is formed in a conical shape.

Optionally, the first opening further includes a third part, the first part, the second part and the third part are communicated sequentially, and the second part is larger than the third part.

Optionally, a washer is disposed in the first opening. The washer is engaged with the first opening to form the first part, the resilient component drives the first pillar to contact against the washer for closing the intake passage as the tank body is uncovered by the lid. The second pillar is inserted into the first opening and passing through the washer to press the first pillar so as to separate the first pillar from the washer to form the first gap between the first pillar and the first inner wall for opening the intake passage as the tank body is covered by the lid.

Optionally, the washer is a silicone circular ring.

Optionally, the tank body includes an upper housing and a lower housing, the chamber is enclosed by the upper housing and the lower housing cooperatively, and the upper side of the tank body is an upper side of the upper housing.

Optionally, a containing area is formed on a second surface of the lid for containing the waterproof moisture-permeable assembly, and the second opening is disposed on the containing area.

Optionally, the waterproof moisture-permeable assembly is a multi-layered structure.

The present invention is further to provide a printer including the ink tank above-mentioned.

The lid of the ink tank of the printer and the intake passage of the present invention are improved. The waterproof moisture-permeable assembly is disposed on the lid, and the intake passage can be closed as the ink tank is not installed in the printer. As the ink tank is at a free state, such as not being installed in the printer, the ink stored in the ink tank can not splash on the waterproof moisture-permeable assembly no matter how to put or crash the tank body, so as to prevent the waterproof moisture-permeable assembly form being stuck and to prevent the flowing velocity of the ink from deceasing due to a bump or a crash of the waterproof moisture-permeable assembly.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
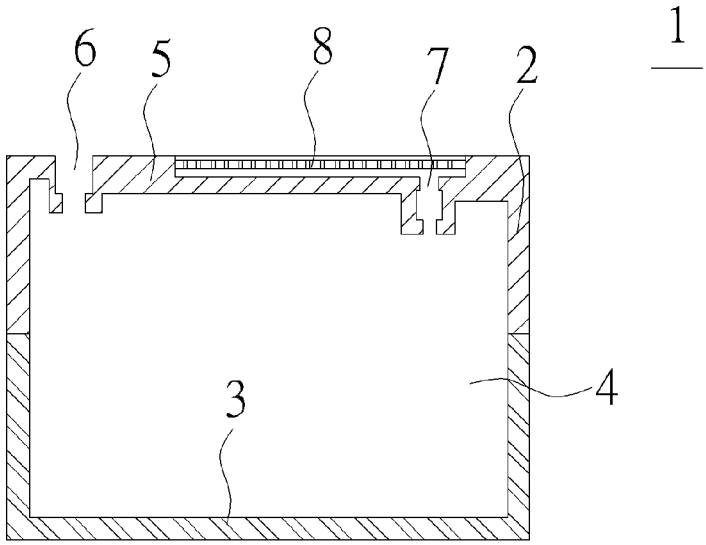
FIG. 1 is a partial structural diagram of a conventional ink tank in the prior art.
Figure 2:
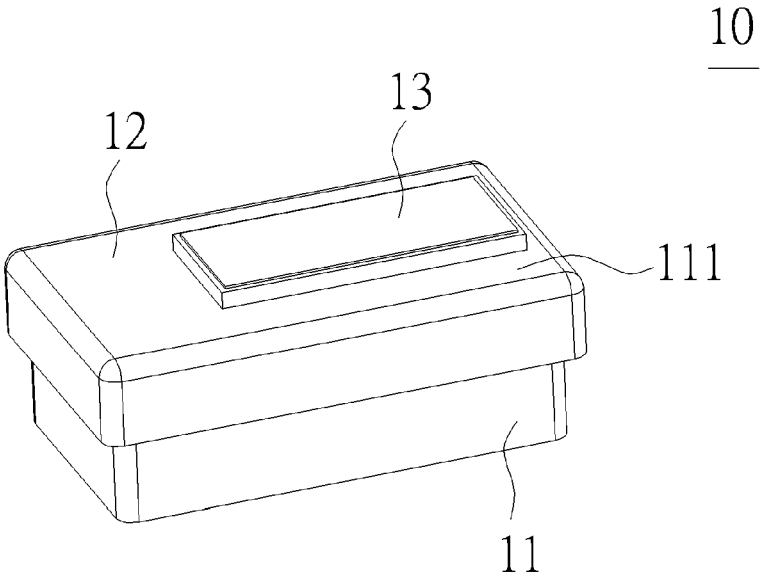
FIG. 2 is a diagram of an ink tank according to an embodiment of the present invention.
Figure 3:
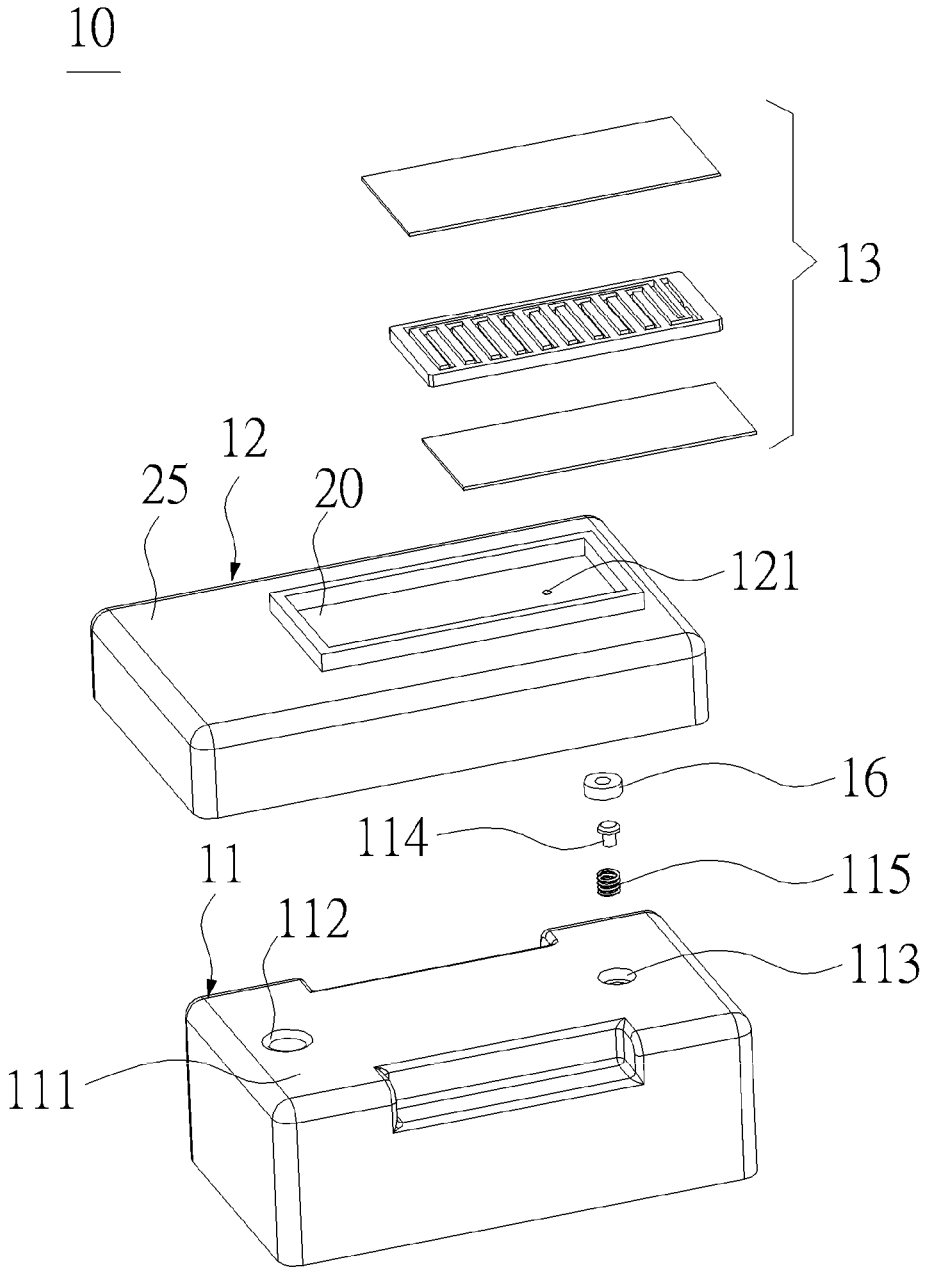
FIG. 3 is an exploded diagram of the ink tank according to the embodiment of the present invention.
Figure 4:
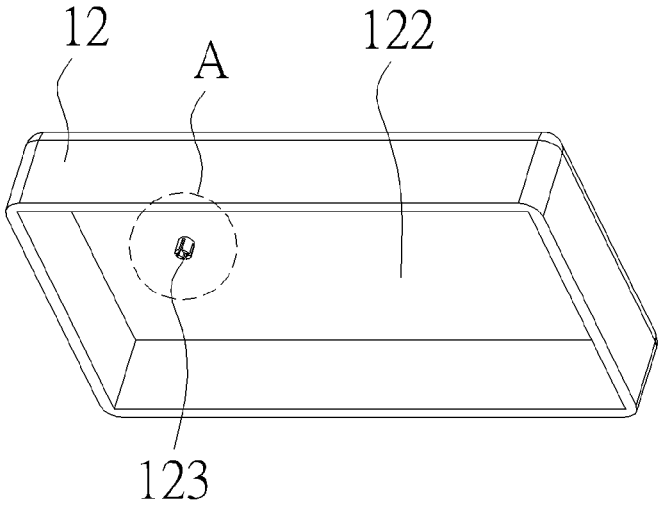
FIG. 4 is a diagram of a lid of the ink tank at a different view angle according to the embodiment of the present invention.
Figure 5:
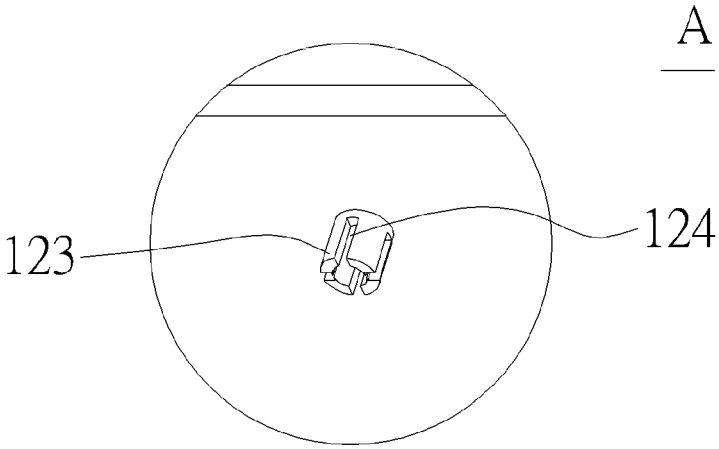
FIG. 5 is an enlarged diagram of area A shown in FIG. 4 according to the embodiment of the present invention.

The present invention is to provide a printer, for example, an ink jet printer. The printer includes an ink tank 10. Please refer to FIG. 2 to FIG. 5. FIG. 2 is a diagram of the ink tank 10 according to an embodiment of the present invention. FIG. 3 is an exploded diagram of the ink tank 10 according to the embodiment of the present invention. FIG. 4 is a diagram of a lid 12 of the ink tank 10 at a different view angle according to the embodiment of the present invention. FIG. 5 is an enlarged diagram of area A shown in FIG. 4 according to the embodiment of the present invention. The ink tank 10 includes a tank body 11, a first pillar 114, a resilient component 115, a lid 12, a second pillar 123 and a waterproof moisture-permeable assembly 13. A chamber is formed inside the tank body 11 for containing ink, and an ink filling port 112 and a first opening 113 are formed on an upper side 111 of the tank body 11.

Generally, the tank body 11 includes an upper housing and a lower housing, a chamber is enclosed by the upper housing and the lower housing cooperatively, and the upper side 111 of the tank body 111 is an upper side of the upper housing. Only the upper housing is illustrated for simplicity. The upper housing and the lower housing can be made of thermoplastic material, the tank body 11 can be formed by welding the upper housing and the lower housing. The ink filling port 112 can further include a seal plug, such as a resilient conical plug, which can be made of silicone or rubber material, and the seal plug is compressed inside the ink filling port 112 of the tank body 11 with interference fit. In addition, an ink outlet is disposed on a bottom of the ink tank 10, a seal plug of the ink outlet can be composed of a seal washer and an inner plug. The arrangement of the ink outlet is not introduced in detail for simplicity.

Figure 6A:
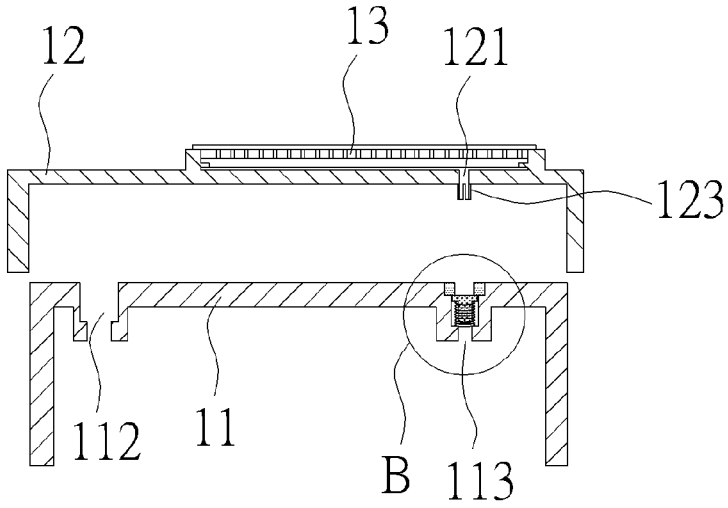
FIG. 6A is a cross-sectional diagram of the ink tank before being assembled according to the embodiment of the present invention.
Figure 6B:
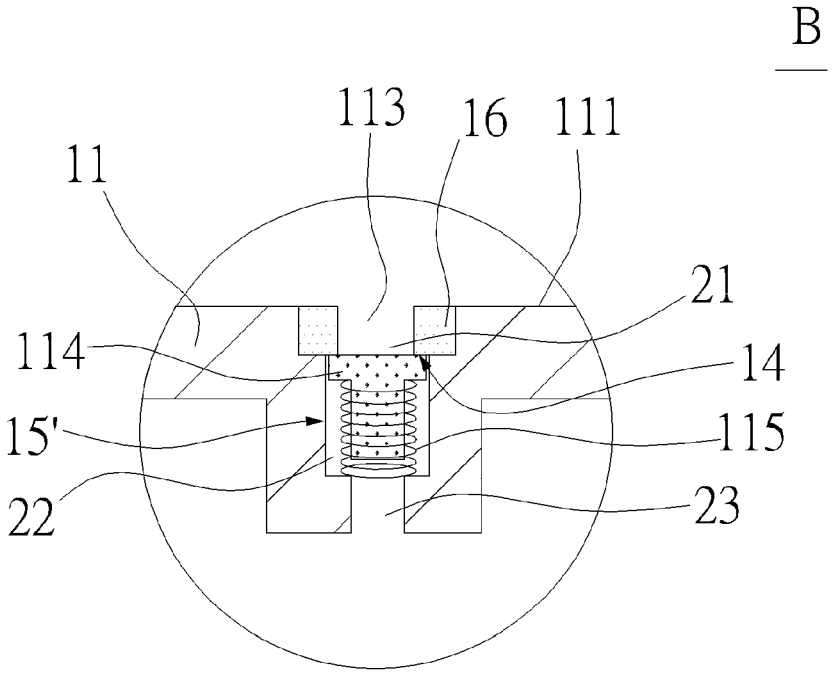
FIG. 6B is an enlarged diagram of area B shown in FIG. 6A according to the embodiment of the present invention.
Figure 7A:
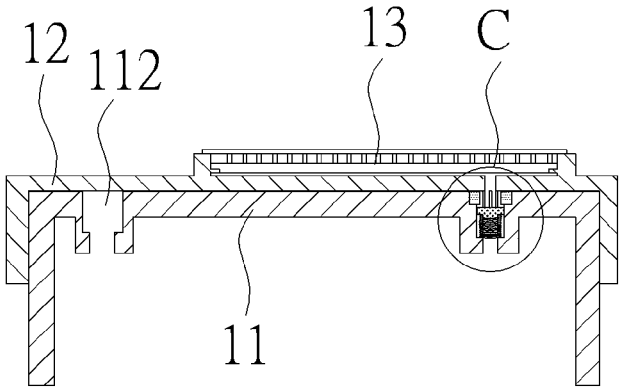
FIG. 7A is a cross-sectional diagram of the ink tank after being assembled according to the embodiment of the present invention.
Figure 7B:
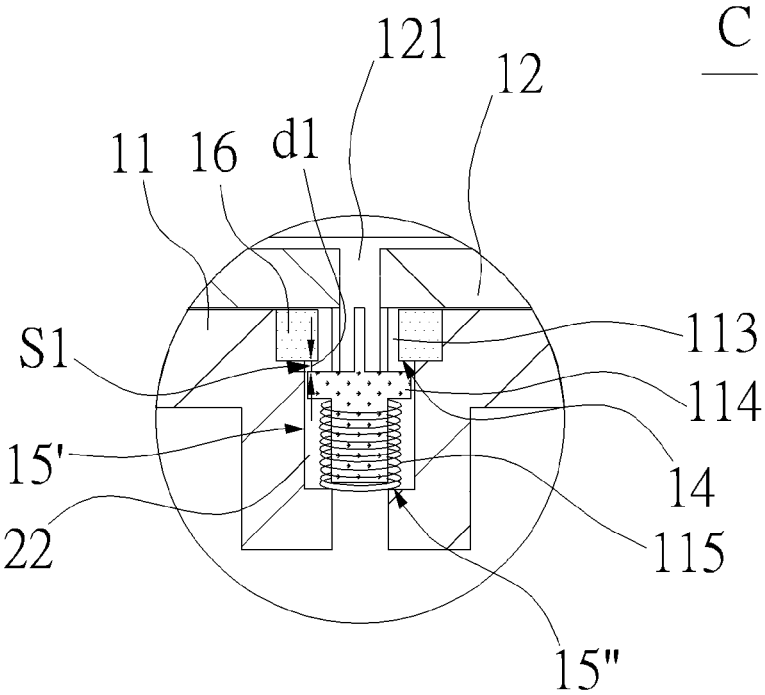
FIG. 7B is an enlarged diagram of area C shown in FIG. 7A according to the embodiment of the present invention.

Please refer to FIG. 6A to FIG. 7B. FIG. 6A is a cross-sectional diagram of the ink tank 10 before being assembled according to the embodiment of the present invention. FIG. 6B is an enlarged diagram of area B shown in FIG. 6A according to the embodiment of the present invention. FIG. 7A is a cross-sectional diagram of the ink tank 10 after being assembled according to the embodiment of the present invention. FIG. 7B is an enlarged diagram of area C shown in FIG. 7A according to the embodiment of the present invention. The first pillar 114 is disposed in the first opening 113. The resilient component 115 is engaged with the first pillar 114 and is disposed in the first opening 113, and the first pillar 114 and the resilient component 115 is engaged with the first opening 113 to form an intake passage S1 communicating with the chamber. The intake passage S1 can be closed or opened.

The lid 12 covers on the upper side 111 of the tank body 11, and a second opening 121 is formed on the lid 12. A second pillar 123 is disposed on a first surface 122 of the lid 12 facing to the upper side 111 of the tank body 11. Such as, the first opening 113 and the second opening 121 are a through-hole. The second pillar 123 includes a communicating portion 124 for communicating with the second opening 121 and the intake passage S1. The communicating portion 124 can be a through slot or a through hole, but not limited to this. The structural design of the communicating portion 124 capable of communicating with the second opening 121 and the intake passage S1 is with the scope of the present invention. According to the embodiment, the communicating portion 124 is a through slot. The waterproof moisture-permeable assembly 13 is disposed on the lid 12 and communicating with the communicating portion 124 through the second opening 121. As shown in FIG. 6B, as the tank body 11 is uncovered by the lid 12, the resilient component 115 is compressed to drive the first pillar 114 to contact against a first inner wall 14 of the tank body 11 so as to close the intake passage S1, so that the chamber of the ink tank 10 is isolated from outside atmosphere.

As shown in FIG. 7B, as the tank body 11 is covered by the lid 12, the second pillar 123 is inserted into the first opening 113 to press the first pillar 114 so as to form a first gap d1 between the first pillar 114 and the first inner wall 14, for opening the intake passage S1. At this time, the chamber is communicated with outside atmosphere through the intake passage S1, the communicating portion 124, the second opening 121 and the waterproof moisture-permeable assembly 13, so that the ink stored in the tank body 11 can flow fluently out through the ink outlet disposed on the bottom of the tank body 11 for printing. Since the waterproof moisture-permeable assembly 13 is disposed on the lid 12, as the ink tank 10 is at a free state, such as not being installed in the printer, and the lid 12 does not cover the tank body 11, the ink stored in the ink tank 10 can not splash on the waterproof moisture-permeable assembly 13 no matter how to put or crash the tank body 11, so as to prevent the waterproof moisture-permeable assembly 13 form being stuck and to prevent the flowing velocity of the ink from deceasing due to a bump or a crash of the waterproof moisture-permeable assembly 13.

In addition, for better communication of the intake passage S1, the communicating portion 124 can include a plurality of through slots or through holes, such as being arranged surrounding an edge of the second pillar 123.

In addition, a containing area 20 is formed on a second surface 25 of the lid 12 for containing the waterproof moisture-permeable assembly 13, so as to fix and protect the waterproof moisture-permeable assembly 13 effectively. Preferably, the second opening 121 can be disposed on the containing area 20. Optionally, the waterproof moisture-permeable assembly 13 can be a multi-layered structure. For example, the waterproof moisture-permeable assembly 13 can be a polytetrafluoroethylene (PTFE) microcellular membrane.

Please continue referring to FIG. 6A to FIG. 7B. According to the embodiment, the first opening 113 includes a first part 21, a second part 22 and a third part 23 communicated sequentially. The second part 22 is larger than the first part 21. The first part 21 is disposed adjacent to the lid 12. The first pillar 114 and the resilient component 115 are disposed in the second part 22. An end of the resilient component 115 contacts against the first pillar 114, and the other end of the resilient component 115 contacts against a second inner wall near the second part 22. The second part 22 is larger than the third part 23 so as to form a stepping structure on an interface between the second part 22 and the third part 23. The second inner wall can be formed on the stepping structure, that is, the second inner wall can be a bottom wall 15" formed on the second part 22, as shown in FIG. 7B. According to another embodiment, the second inner wall can be a sidewall 15' formed on the second part 22, and the resilient component 115 can be formed in a conical shape accordingly. A cross-section area of an end of the resilient component 115 adjacent to the third part 23 is larger than a cross-section area of the second part 22, so that the other end of the resilient component 115 can contact against the sidewall 15'. The resilient component 115 can be a spring or a resilient sheet, but not limited to this. The resilient component 115 can have enhanced elastic deformation.

According to another embodiment, the first opening 113 can only include the first part 21 and the second part 22, and the resilient component 115 can be formed in a conical shape accordingly. The cross-section area of the end of the resilient component 115 adjacent to the third part 23 is larger than the cross-section area of the second part 22, so that the other end of the resilient component 115 contacts against the sidewall 15'.

Preferably, according to another embodiment, the first opening 113 can be formed in a conical shape. That is, a diameter of an end of the first opening 113 adjacent to the lid 12 is smaller, so as to adjust the first gap d1 between the first pillar 114 and the first inner wall 14, for controlling the flowing velocity of the ink as the ink tank 10 is in operation.

In addition, a washer 16 is disposed in the first opening 113. The washer 16 is engaged with the first opening 113 to form the first part 21. The resilient component 115 drives the first pillar 114 to contact against the washer 16 for closing the intake passage S1 as the tank body 11 is uncovered by the lid 12. At this time, the chamber is isolated from the outside atmosphere, the ink stored in the tank body 11 can not flow fluently, and it is not able to operate the printer. Accordingly, the first inner wall 14 forming the intake passage S1 is formed on the position that the washer 16 contacts against the first pillar 114. As the tank body 11 is covered by the lid 12, the second pillar 123 is inserted into the first opening 113 and passing through the washer 16 to press the first pillar 114 so as to separate the first pillar 114 from the washer 16, so as to form the first gap dl between the first pillar 114 and the first inner wall 14 for opening the intake passage S1. At this time, the chamber is communicated with the outside atmosphere. For example, the washer 16 can be a silicone circular ring. Because the washer 16 is resilient, it is more effective to seal the first opening 113 by disposing the seal washer 16 in the first opening 113.

In contrast to the prior art, the lid of the ink tank of the printer and the intake passage of the present invention are improved. The waterproof moisture-permeable assembly is disposed on the lid, and the intake passage can be closed as the ink tank is not installed in the printer. As the ink tank is at the free state, such as not being installed in the printer, the ink stored in the ink tank can not splash on the waterproof moisture-permeable assembly no matter how to put or crash the tank body, so as to prevent the waterproof moisture-permeable assembly form being stuck and to prevent the flowing velocity of the ink from deceasing due to a bump or a crash of the waterproof moisture-permeable assembly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An ink tank comprising:

a tank body, a chamber being formed inside the tank body for containing ink, an ink filling port and a first opening being formed on an upper side of the tank body;

a first pillar disposed in the first opening;

a resilient component engaging with the first pillar and disposed in the first opening, the first pillar and the resilient component being engaged with the first opening to form an intake passage communicating with the chamber;

a lid covering on the upper side of the tank body, a second opening being formed on the lid;

a second pillar being disposed on a first surface of the lid facing to the upper side of the tank body, the second pillar comprising a communicating portion communicating with the second opening and the intake passage; and a waterproof moisture-permeable assembly disposed on the lid and communicating with the communicating portion through the second opening;

wherein the resilient component is compressed to drive the first pillar to contact against a first inner wall of the tank body so as to close the intake passage as the tank body is uncovered by the lid, and the second pillar is inserted into the first opening to press the first pillar so as to form a first gap between the first pillar and the first inner wall, for opening the intake passage so as to communicate the chamber and outside atmosphere as the tank body is covered by the lid.

2. The ink tank of claim 1, wherein a first opening comprises a first part and a second part, the second part is larger than the first part, the first part is disposed adjacent to the lid, the first pillar and the resilient component are disposed in the second part, an end of the resilient component contacts against the first pillar, and the other end of the resilient component contacts against a second inner wall near the second part.

3. The ink tank of claim 2, wherein the first opening is formed in a conical shape.

4. The ink tank of claim 2, wherein the first opening further comprises a third part, the first part, the second part and the third part are communicated sequentially, and the second part is larger than the third part.

5. The ink tank of claim 2, further comprising a washer disposed in the first opening, the washer being engaged with the first opening to form the first part, the resilient component driving the first pillar to contact against the washer to close the intake passage as the tank body is uncovered by the lid, and the second pillar being inserted into the first opening and passing through the washer to press the first pillar so as to separate the first pillar from the washer to form the first gap between the first pillar and the first inner wall for opening the intake passage as the tank body is covered by the lid.

6. The ink tank of claim 5, wherein the washer is a silicone circular ring.

7. The ink tank of claim 1, wherein the tank body comprises an upper housing and a lower housing, the chamber is enclosed by the upper housing and the lower housing cooperatively, and the upper side of the tank body is an upper side of the upper housing.

8. The ink tank of claim 1, wherein a containing area is formed on a second surface of the lid for containing the waterproof moisture-permeable assembly, and the second opening is disposed on the containing area.

9. The ink tank of claim 1, wherein the waterproof moisture-permeable assembly is a multi-layered structure.

10. A printer comprising:

an ink tank comprising:

a tank body, a chamber being formed inside the tank body for containing ink, an ink filling port and a first opening being formed on an upper side of the tank body;

a first pillar disposed in the first opening;

a resilient component engaging with the first pillar and disposed in the first opening, the first pillar and the resilient component being engaged with the first opening to form an intake passage communicating with the chamber;

a lid covering on the upper side of the tank body, a second opening being formed on the lid;

a second pillar being disposed on a first surface of the lid facing to the upper side of the tank body, the second pillar comprising a communicating portion communicating with the second opening and the intake passage; and a waterproof moisture-permeable assembly disposed on the lid and communicating with the communicating portion through the second opening;

wherein the resilient component is compressed to drive the first pillar to contact against a first inner wall of the tank body so as to close the intake passage as the tank body is uncovered by the lid, and the second pillar is inserted into the first opening to press the first pillar so as to form a first gap between the first pillar and the first inner wall, for opening the intake passage so as to communicate the chamber and outside atmosphere as the tank body is covered by the lid.

11. The printer of claim 10, wherein a first opening comprises a first part and a second part, the second part is larger than the first part, the first part is disposed adjacent to the lid, the first pillar and the resilient component are disposed in the second part, an end of the resilient component contacts against the first pillar, and the other end of the resilient component contacts against a second inner wall near the second part.

12. The printer of claim 11, wherein the first opening is formed in a conical shape.

13. The printer of claim 11, wherein the first opening further comprises a third part, the first part, the second part and the third part are communicated sequentially, and the second part is larger than the third part.

14. The printer of claim 11, further comprising a washer disposed in the first opening, the washer being engaged with the first opening to form the first part, the resilient component driving the first pillar to contact against the washer to close the intake passage as the tank body is uncovered by the lid, and the second pillar being inserted into the first opening and passing through the washer to press the first pillar so as to separate the first pillar from the washer to form the first gap between the first pillar and the first inner wall for opening the intake passage as the tank body is covered by the lid.

15. The printer of claim 14, wherein the washer is a silicone circular ring.

16. The printer of claim 10, wherein the tank body comprises an upper housing and a lower housing, the chamber is enclosed by the upper housing and the lower housing cooperatively, and the upper side of the tank body is an upper side of the upper housing.

17. The printer of claim 10, wherein a containing area is formed on a second surface of the lid for containing the waterproof moisture-permeable assembly, and the second opening is disposed on the containing area.

18. The printer of claim 10, wherein the waterproof moisture-permeable assembly is a multi-layered structure.

* * * * *